US005845988A

United States Patent [19]

Mandall

[11] Patent Number: 5,845,988

[45] Date of Patent: Dec. 8, 1998

[54] ARMORED LIGHTING FIXTURE

[76] Inventor: Michael C. Mandall, 5442 E. Cambridge Ave., Phoenix, Ariz. 85018

[21] Appl. No.: 845,684

[22] Filed: Apr. 28, 1997

[51] Int. Cl.[6] ..... F21V 15/00

[52] U.S. Cl. ..... 362/376; 362/377; 362/378; 362/221; 362/278; 362/301

[58] Field of Search ..... 362/376, 377, 362/378, 221, 278, 301

[56] References Cited

U.S. PATENT DOCUMENTS

| | | | |
|---|---|---|---|
| 2,678,380 | 5/1954 | Westby | 362/221 X |
| 3,404,886 | 10/1968 | Dundr . | |
| 3,829,677 | 8/1974 | DeLlano | 240/51.11 R |
| 3,860,829 | 1/1975 | Fabbri | 362/221 X |
| 4,150,422 | 4/1979 | Peralta et al. | 362/218 |
| 4,453,202 | 6/1984 | Morris et al. | 362/147 |
| 4,499,529 | 2/1985 | Figueroa | 362/283 |
| 4,599,684 | 7/1986 | Lee | 362/346 |
| 4,799,134 | 1/1989 | Pinch et al. | 362/217 |
| 4,933,820 | 6/1990 | Engel | 362/217 |
| 5,025,356 | 6/1991 | Gawad | 362/221 |
| 5,222,798 | 6/1993 | Adams | 362/110 |
| 5,357,413 | 10/1994 | Mandall | 362/300 |

*Primary Examiner*—Ira S. Lazarus
*Assistant Examiner*—David Lee
*Attorney, Agent, or Firm*—Cahill, Sutton & Thomas P.L.C.

[57] ABSTRACT

An armored housing has resiliently supported therein the combined weight of a reflector structure, a lamp in the reflector structure and an electrical component, such as a ballast, mounted on the reflector structure. The reflector structure preferably comprises an extruded aluminum reflector support and a sheet metal reflector.

6 Claims, 3 Drawing Sheets

37
36

14
12
18
3
37
4
4
15
17
21
20
19
32
28
22
14
18
11
13

ARMORED LIGHTING FIXTURE

TECHNICAL FIELD

This invention is concerned with providing reliable outdoor illumination of areas subject to vandalism. Specifically, the invention provides a lighting fixture in which the lamp therein is protected by armor against firearms projectiles.

BACKGROUND ART

Outdoor lighting fixtures are frequently subjected to breakage by criminal activities. Often, vandals will seek to extinguish the light merely for sport by throwing rocks or launching other projectiles, such as bullets fired from guns. Or, criminals may seek to extinguish the light to permit them to carry out criminal activities, such as theft, undetected.

My U.S. Pat. No. 5,357,414 granted Oct. 18, 1994 for "ARMORED LIGHTING FIXTURE" discloses a fixture having a housing formed of armor plate for protecting a lamp situated inside. The housing is open at the top to permit light to be emitted but has closed sides and a bottom to fend off projectiles fired from beneath the fixture.

That prior fixture has a reflector structure and a lamp resiliently suspended inside the housing to isolate the reflector structure and particularly the lamp from the shocks of projectiles striking the housing.

DISCLOSURE OF THE INVENTION

This invention is an improvement over my prior lighting fixture in that it reduces the likelihood that the lamp will be damaged by a projectile striking the armored housing.

The invention contemplates affixing to a resiliently supported reflector structure auxiliary electrical components for the lamp such as a ballast, a condenser and a starter. The combined mass of the lamp, reflector structure and auxiliary electrical components, particularly the ballast, renders it unlikely that any forces transmitted through the resilient suspension system will cause lamp damaging motion of the combination.

The invention further contemplates a reflector structure which includes a substantially rigid, extruded aluminum reflector support and a flexible sheet metal reflector.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
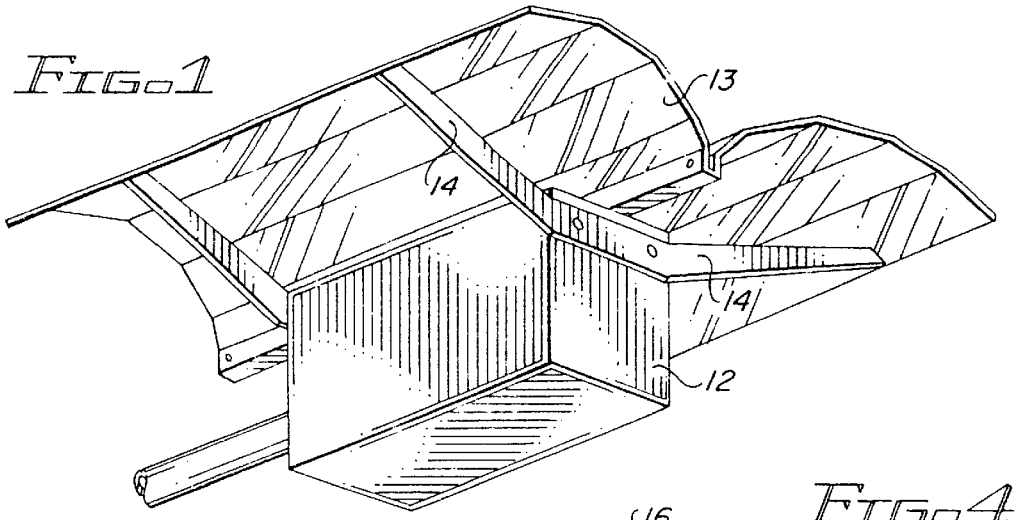
FIG. 1 is a perspective view of a lighting fixture embodying the invention.

In the drawing the numeral 11 designates generally the lighting fixture of this invention. Fixture 11 is depicted in its entirety in FIG. 1 and FIGS. 2–5 illustrate its details of construction.

The principal external components of the fixture 11 are an armored housing 12 and an upper double parabolic reflector 13 supported above the housing by arms 14.

Housing 12 is a box-like structure fabricated from armor plate, preferably a modified chrome moly steel of 500 Burnell REM. Housing 12 is open at the top to permit egress of light from a lamp 15. Light leaving the housing is reflected downwardly over a large area by upper reflector 13. A glass cover 16 is preferably provided for the open upper face of the housing 12 to prevent moisture and debris from entering the housing.

Lamp 15 is carried within housing 12 by a reflector structure 17 resting on resilient support means 18 at its four corners. Mounted on the under side of reflector structure 17 are auxiliary electrical components for the lamp. These components comprise a ballast 19, a condenser 20 and a starter 21.

It is an important feature of this invention that the lamp 15, the reflector structure 17 and the electrical components 19, 20 and 21, particularly the heavy ballast 19, are solidly connected, or affixed to each other. Together they constitute a considerably mass which resists lamp damaging movement as a result of forces traversing the resilient support means from projectile strikes of the housing 12.

Figure 4:
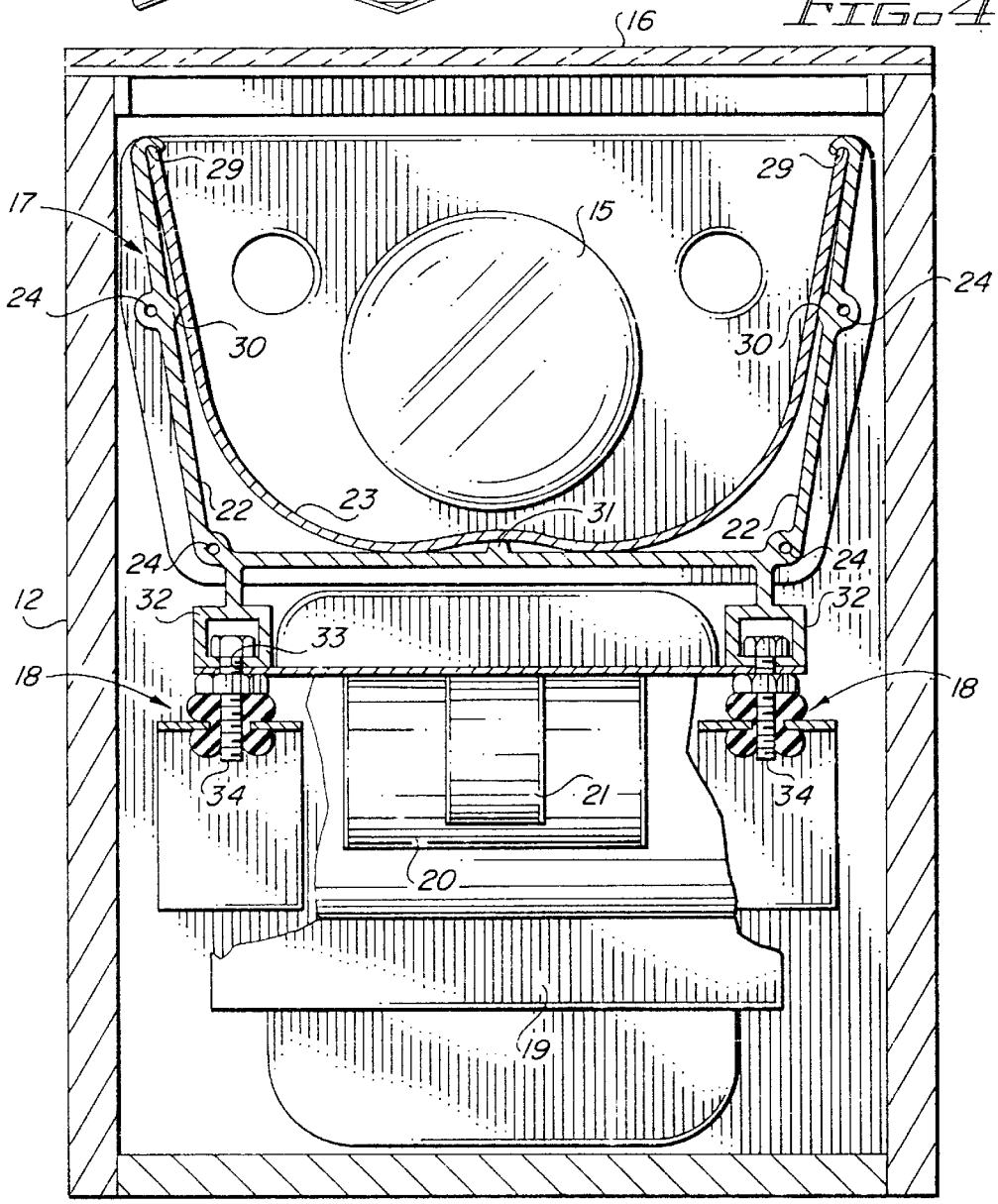
FIG. 4 is a vertical sectioned view of the fixture taken generally as indicated by line 4—4 in FIG. 2.
Figures 2, 3:
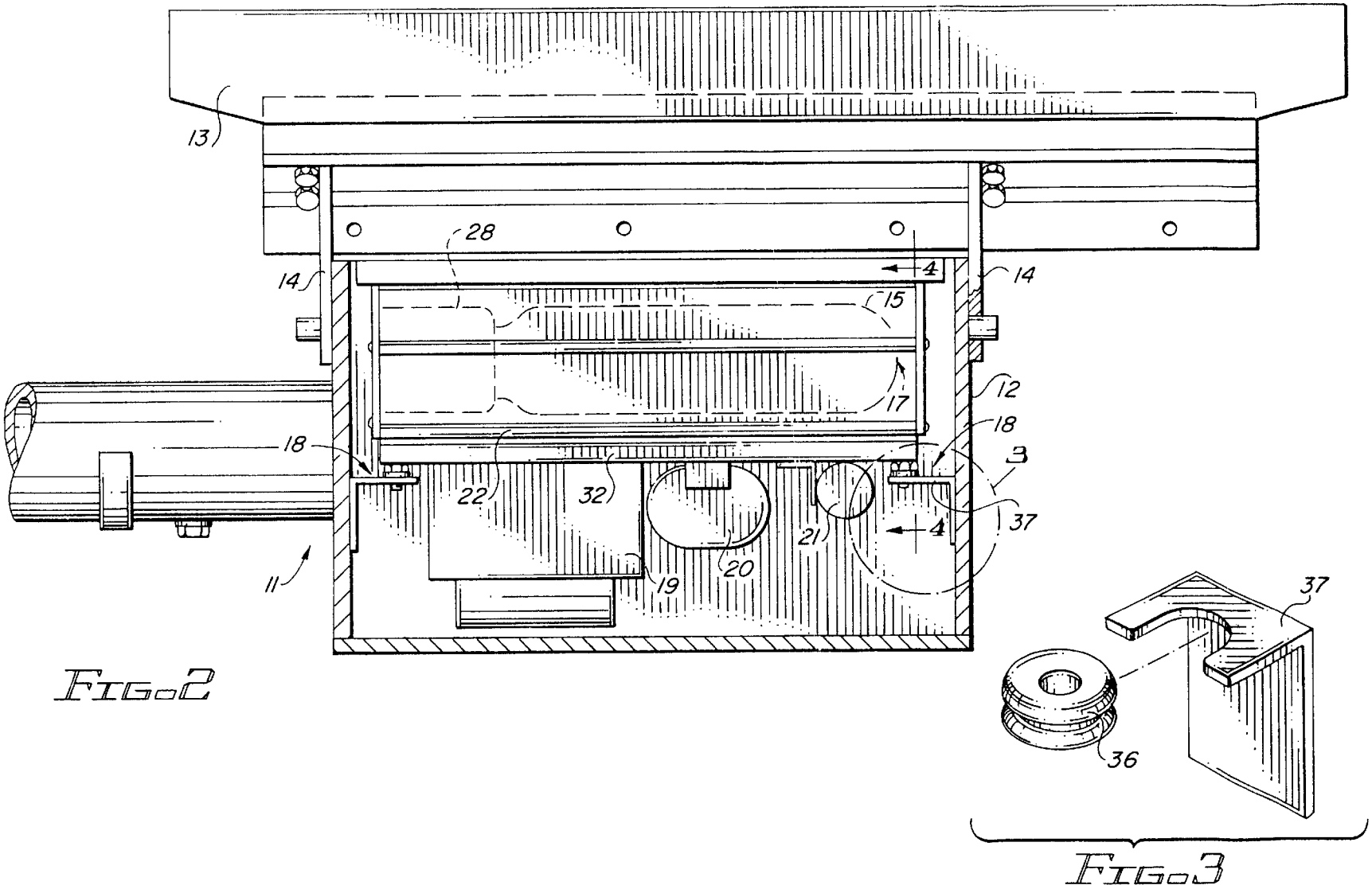
FIG. 2 is a vertical side view of the fixture with the armored housing sectioned to show the internal components.
FIG. 3 is an enlarged perspective of a resilient support located in an area within circle 3 in FIG. 2.
Figure 5:
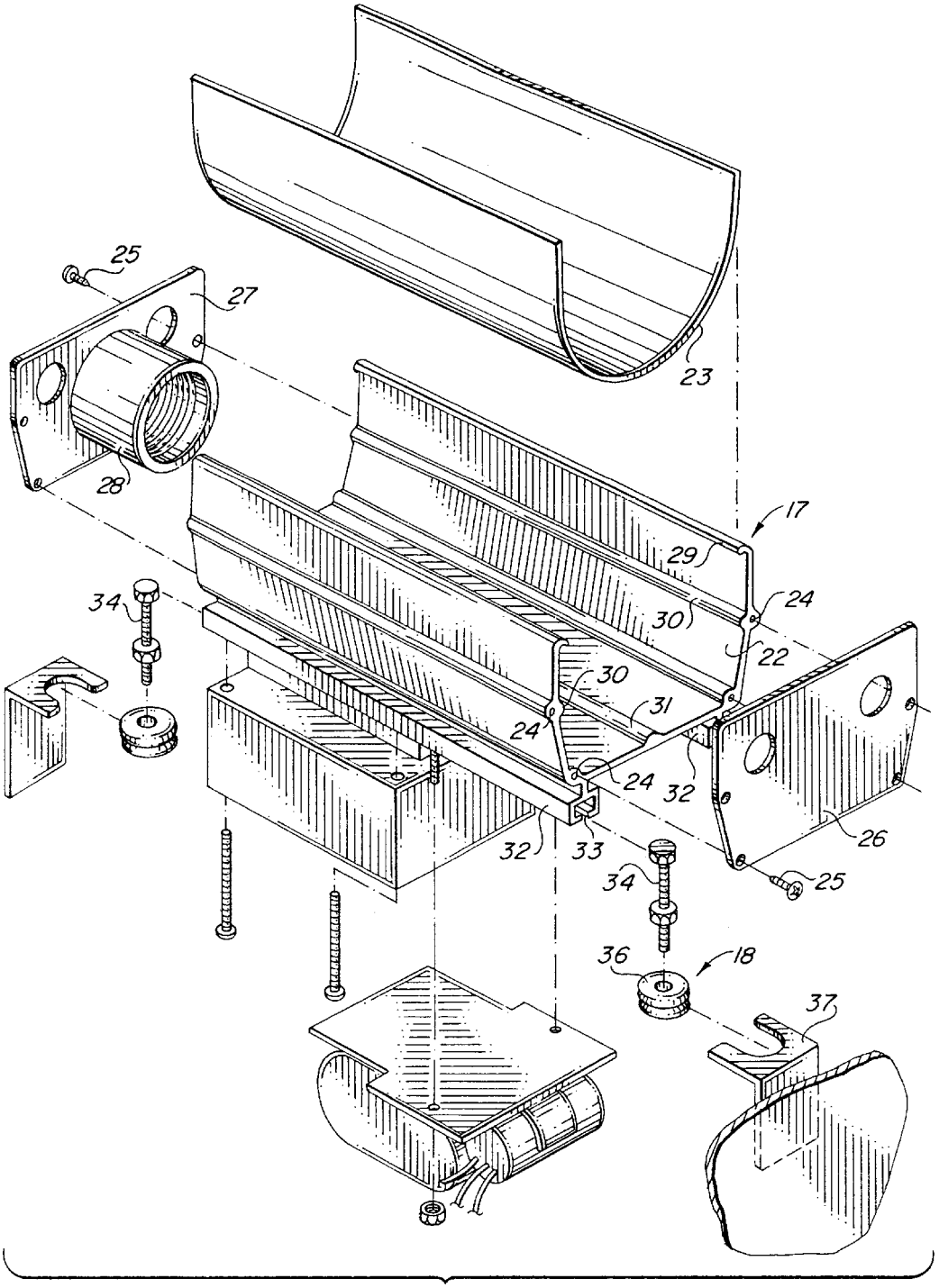
FIG. 5 is an exploded perspective view of the internal components of the fixture.

Reflector structure 17 preferably has two components, namely, a rigid, generally U-shaped reflector support 22 and a flexible, sheet reflector 23 (See FIGS. 4 and 5). Reflector support 22 is preferably an elongated aluminum extrusion with configuration details which facilitate cooperation with the lamp 15, the sheet reflector 23, the auxiliary electrical components 19, 20 and 21 and the resilient support means 18.

First, with respect to the connection between the lamp 15 and the reflector support 22, it will be noted that support extrusion includes tubular boxes 24 at strategic locations around the support. The boxes 24 are adapted to receive screws 25 for securing end plates 26 and 27 to the ends of the reflector support 22. Rear end plate 27 carries a socket 23 for receiving the threaded base (not shown) of lamp 15. There is thus provided a secure connection between the lamp 15 and reflector support 22.

Next, with respect to the connection between the reflector support 22 and the sheet reflector 23 it will be noted that the reflector support has formed thereon opposing lips 29 along the upper edges of the support, inwardly projecting ribs 30 on the side walls of the support and a central rib 31 on the bottom of the support. With the sheet reflector 23 bent to a generally U-shape and slid into the support 22 with the outer edges of the reflector beneath lips 29, the ribs 30 and 31 impart a double parabolic cross section to the reflector (See FIG. 4).

Highly reflective sheet material for reflector 23 is inexpensive as is the aluminum extrusion for reflector support 22. Thus, by practicing the assembly technique described above, a reflector is produced at a much lower cost than with virtually all other fabrication and polishing techniques.

It should further be noted that the reflector support 22 is also preferably extruded with a pair of box rails 32 extending longitudinally beneath the body of the support. Each box rail 32 has a slot 33 in its bottom face permitting the heads of mounting bolts 34 to be slid into the rail. Mounting bolts 34 can be clamped in position in box rails 32 by means of nuts 35 threaded thereon. These bolts 34 function as portions of the resilient support means 18 in that they each extend into a resilient grommet 36 carried by a bracket 37 welded or otherwise affixed to a wall of housing 12.

Box rails 32 also provide a convenient mechanism for securing the auxiliary electrical components 19, 20 and 21 to the reflector support.

From the foregoing it should be apparent that this invention provides an armored light fixture of convenient and inexpensive construction which affords improved protection for the lamp inside.

What is claimed is:

1. An armored lighting fixture, said fixture comprising an armored housing formed of armor plate and having an opening therein through which light is emitted, a reflector structure positioned in said housing, means for resiliently supporting the reflector structure in said housing, a lamp positioned in said reflector structure, and an auxiliary electrical component for said lamp secured to said reflector structure whereby the electrical component contributes to the mass of the reflector structure and the combined mass of the lamp, the reflector structure and the electrical component is isolated from blows to the armored housing by the resiliently supporting means.

2. An armored lighting fixture as defined by claim 1 wherein said auxiliary electrical component is a ballast.

3. An armored lighting fixture as defined by claim 1 wherein said reflector structure comprises a substantially rigid reflector support and a flexible reflector carried by the reflector support and said auxiliary electrical component is secured to the reflector support.

4. An armored lighting fixture as defined in claim 3 wherein said auxiliary electrical component is a ballast.

5. An armored lighting fixture, said fixture comprising an armored housing formed of armor plate and having a top opening through which light is emitted, a reflector structure positioned in said housing, said reflector structure comprising a substantially rigid reflector support and a flexible reflector carried by the reflector support, a lamp positioned in said reflector structure, a ballast mounted on said reflector support, and means for resiliently supporting the combined weight of the lamp, the reflector structure and the ballast in said housing and for isolating those components from blows to the housing.

6. An armored lighting fixture as defined in claim 5 wherein said reflector support is a generally U-shaped aluminum extrusion and said flexible reflector is sheet metal and said reflector support holds the flexible reflector in a reflecting configuration.

* * * * *